US008920232B2

(12) United States Patent
Colletti et al.

(10) Patent No.: US 8,920,232 B2
(45) Date of Patent: Dec. 30, 2014

(54) GAMING EVENT MANAGEMENT SYSTEM

(75) Inventors: Todd Colletti, San Francisco, CA (US); Sam Parker, San Francisco, CA (US); Ethan Schlenker, San Francisco, CA (US)

(73) Assignee: CBS Interactive Inc., San Francisco, CA (US)

( * ) Notice: Subject to any disclaimer, the term of this patent is extended or adjusted under 35 U.S.C. 154(b) by 1575 days.

(21) Appl. No.: 11/826,829

(22) Filed: Jul. 18, 2007

(65) Prior Publication Data

US 2009/0023494 A1 Jan. 22, 2009

(51) Int. Cl.
*A63F 9/24* (2006.01)

(52) U.S. Cl.
USPC ..... 463/25; 463/42

(58) Field of Classification Search
USPC ..... 463/23, 42, 16
See application file for complete search history.

(56) References Cited

U.S. PATENT DOCUMENTS

| | | | | |
|---|---|---|---|---|
| 5,692,125 | A | 11/1997 | Schloss et al. | |
| 5,779,549 | A | 7/1998 | Walker et al. | |
| 5,917,725 | A | 6/1999 | Thacher et al. | |
| 6,224,486 | B1 | 5/2001 | Walker | |
| 6,352,479 | B1 | 3/2002 | Sparks, II | |
| 6,425,828 | B2 | 7/2002 | Walker | |
| 6,688,978 | B1 | 2/2004 | Herman | |
| 6,786,824 | B2 | 9/2004 | Cannon | |
| 6,929,546 | B2 | 8/2005 | Moore et al. | |
| 7,684,882 | B2 * | 3/2010 | Baerlocher et al. | 700/92 |
| 2001/0004609 | A1 | 6/2001 | Walker et al. | |
| 2002/0016729 | A1 | 2/2002 | Breitenbach et al. | |
| 2002/0115488 | A1 | 8/2002 | Berry et al. | |
| 2002/0120734 | A1 | 8/2002 | Riosa et al. | |
| 2002/0193162 | A1 | 12/2002 | Walker et al. | |
| 2003/0186744 | A1 | 10/2003 | Bradell | |
| 2003/0190960 | A1 | 10/2003 | Jokipii | |
| 2003/0224856 | A1 | 12/2003 | Bukovsky et al. | |
| 2004/0005926 | A1 | 1/2004 | LeFroy | |
| 2004/0152516 | A1 | 8/2004 | Blatter et al. | |
| 2004/0229700 | A1 | 11/2004 | Cannon et al. | |
| 2005/0086301 | A1 | 4/2005 | Eichler et al. | |
| 2005/0148380 | A1 | 7/2005 | Guinn et al. | |
| 2005/0181856 | A1 | 8/2005 | Cannon et al. | |
| 2006/0148565 | A1 | 7/2006 | Gauselmann et al. | |
| 2007/0026935 | A1 * | 2/2007 | Wolf et al. | 463/25 |

* cited by examiner

*Primary Examiner* — Masud Ahmed
(74) *Attorney, Agent, or Firm* — Marc S. Kaufman; Reed Smith LLP

(57) ABSTRACT

An event management architecture (EMA) for managing gaming events includes a plurality of sub-events associated with a gaming event. Each sub-event has at least one sub-event participant and provides a sub-event score to each sub-event participant according to a set of sub-event rules during a sub-event interval. A scheduling coordinator schedules, for each sub-event, the sub-event interval. A registration coordinator registers, for each sub-event, each participant. A scoring processor records, for each sub-event, the sub-event score for each participant, where the sub-event score is converted into a standard format. Each sub-event may be associated with a generic sub-event container, which takes advantage of the common characteristics or functionality requirements of the sub-events to facilitate the management of the sub-events. The EMA minimizes the need to administer the events individually, and can be scalably used to manage complex arrangements of interdependent sub-events of varying types.

68 Claims, 10 Drawing Sheets

GAMING EVENT MANAGEMENT SYSTEM

BACKGROUND OF THE INVENTION

1. Field of the Invention

The present invention relates generally to management of a gaming event, and more particularly, to management of gaming events that include complex arrangements of interdependent sub-events of varying types.

2. Description of Related Art

Electronic gaming has become a significant industry with the development of computer and media technology. In particular, online gaming, which allows remotely located players to interact or compete in an electronic gaming environment or gaming community, has grown in popularity with the development of the Internet and networking technologies.

The interaction between players in online gaming is not limited to playing with, or against, each other in a single instance of an electronic game. For instance, players can interact with each other in gaming tournaments, which require players to play a series of instances of an electronic game. As such, gaming tournaments constitute gaming events that are made of a series of sub-events, where each sub-event corresponds with one instance of an electronic game.

In many cases, the arrangement of sub-events in a tournament involves a simple single-elimination system where the players are paired in head-to-head competition in each round. The losers in each round are eliminated from the tournament, and the winners advance to be paired with each other in the next round. The field of players is halved in each round until a single winner emerges. The prerequisite for playing in a particular round is outscoring one's opponent in all prior rounds. After the initial round, the occurrence of a particular sub-event in a round merely depends on the outcome of two sub-events in the previous round, as the winners of the two previous sub-events advance to play each other. In a single-elimination system, the interdependence between the individual gaming events is straightforward. The pool of participating players is easy to track, and setting up the individual sub-events is simple. As a result, the complexities of managing the tournament are minimized.

Managing a tournament is further simplified by having the players in every individual gaming event play the same electronic game. In this way, all players in the tournament are simply evaluated according to the same set of rules. In particular, there is no requirement to account for disparate scoring systems. Furthermore, complexity is also reduced when the electronic games are executed on servers that are compatible with a particular network and are able to communicate the outcomes of the sub-events with each other and set up subsequent sub-events.

Although other tournament formats for online electronic gaming may exist, the formats are simple and the variety of formats remains limited due to an inadequate capability to manage more complex arrangements and dependencies.

SUMMARY OF THE INVENTION

In order to enable the creation of more complex arrangements of sub-events, embodiments of the present invention provide systems and methods for managing gaming events that may include any arrangement of, and any number of, interdependent sub-events. Exemplary embodiments of the present invention provide an event management architecture (EMA). Using a generic sub-event container and a scheduling mechanism, the EMA permits sub-events to be arranged into large-scale gaming events, where success or participation in one, or a series of, sub-events, is a prerequisite for involvement in a later sub-event. Accordingly, the EMA enables management of arbitrarily large cascading trees of interdependent events.

While the EMA may be employed to manage the electronic gaming tournaments described previously, the present invention may be applied to gaming events that include any combination of non-electronic as well as electronic sub-events. Sub-events may include games, quizzes, contests, scavenger hunts, tournaments, or other activity requiring user participation. In fact, gaming events that include sub-events may themselves also be sub-events for larger gaming events. For example, a tournament or scavenger hunt which is actually made of a set of sub-events may be a part of a larger gaming event. Additionally, a gaming event may include any number of sub-events that have different rules and scoring schemes. Also, the sub-events in a gaming event may occur through a sub-event system integrated with the EMA or through a standalone system.

In an exemplary embodiment of the present invention, an EMA system for managing gaming events includes a plurality of sub-events associated with a gaming event. Each sub-event has at least one sub-event participant and provides a sub-event score to each sub-event participant according to a set of sub-event rules during a sub-event interval. A scheduling coordinator schedules, for each sub-event, the sub-event interval. Furthermore, a registration coordinator registers, for each sub-event, each sub-event participant. Meanwhile, a scoring processor records, for each sub-event, the sub-event score for each sub-event participant, where the sub-event score is converted into a standard format. Each sub-event may be associated with a generic sub-event container, and the EMA may operate with the generic sub-event container. The generic sub-event container takes advantage of the common characteristics or functionality requirements of sub-events to facilitate the management of the sub-events. For instance, standardized marketing and advertising may be applied through the system to each sub-event in a gaming event. Thus, the EMA minimizes the need to administer the events individually, and the EMA can be scalably used to manage complex arrangements of interdependent sub-events of varying types.

These and other aspects of the present invention will become more apparent from the following detailed description of the preferred embodiments of the present invention when viewed in conjunction with the accompanying drawings.

DETAILED DESCRIPTION

Figure 1:
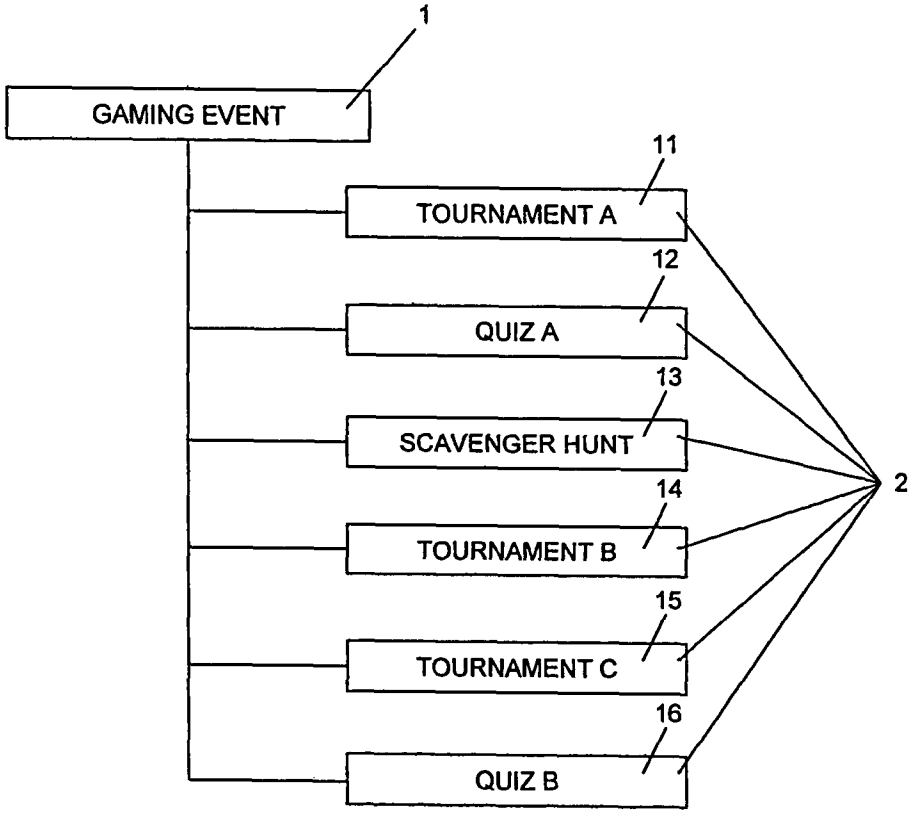
FIG. 1 illustrates an example of a gaming event having a plurality of sub-events of varying types.

Referring to FIG. 1, a gaming event 1 having a plurality of sub-events 2 is illustrated. The gaming event 1 shown in FIG. 1 is presented herein merely as an example to illustrate various aspects of a gaming event that are advantageously managed by embodiments of the present invention.

The sub-events 2 in FIG. 1 include six different gaming sub-events 11, 12, 13, 14, 15, and 16. However, gaming events, in general, may have any number of sub-events of any type of game or activity. Sub-events may be games, quizzes, contests, scavenger hunts, tournaments, or other activity requiring user participation. For instance, as shown in FIG. 1, the game types for the sub-events 11, 12, 13, 14, 15, and 16 include tournament, quiz, and scavenger hunt formats. Typically, each sub-event occurs over a specified time interval and provides a score to each participant according to a set of rules. The set of rules, which includes a scoring scheme, may vary for each sub-event in a gaming event.

As the number of sub-events in a gaming event increases and the types of sub-events increase in variety, the gaming event becomes more complex. Indeed, gaming events that include sub-events may themselves also be sub-events for larger gaming events. However, it has been realized that many sub-events have common characteristics or features, which can be used to define generic sub-event containers, or wrappers, that can be managed from a standard centralized administrative facility. Accordingly, by employing generic sub-event containers, embodiments of the present invention provide systems and methods for managing gaming events that may include any arrangement of, and any number of, interdependent sub-events of varying types. Advantageously, such embodiments minimize the need to repeatedly execute, or redeploy, the same administrative functions for each sub-event.

Figure 2:
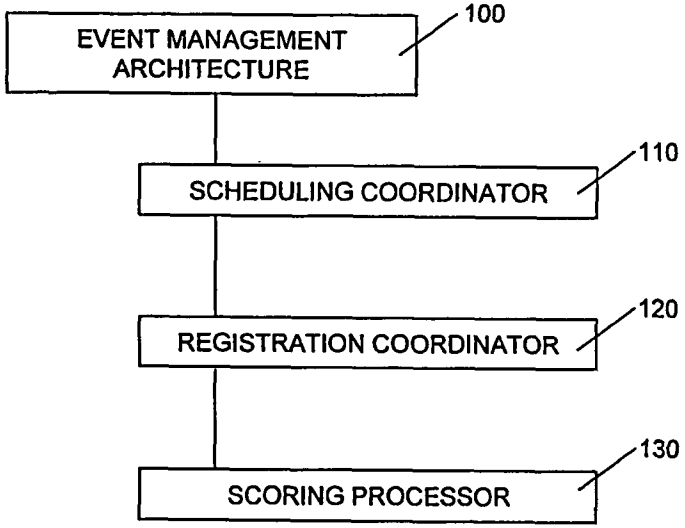
FIG. 2 illustrates a functional schematic for an exemplary embodiment of an event management architecture.

As shown in the high-level schematic of FIG. 2, an embodiment of the present invention provides event management architecture (EMA) 100. The EMA 100 provides a framework for managing gaming events that include any arrangement of sub-events. The EMA 100 may include a scheduling coordinator 110, a registration coordinator 120, and a scoring processor 130. As described in detail below, the scheduling coordinator 110 schedules the sub-events, and the registration coordinator registers participants for each scheduled sub-event. Meanwhile, the scoring processor 110 records a score for each participant of each sub-event, converting the score into a standard format if necessary.

Figure 3:
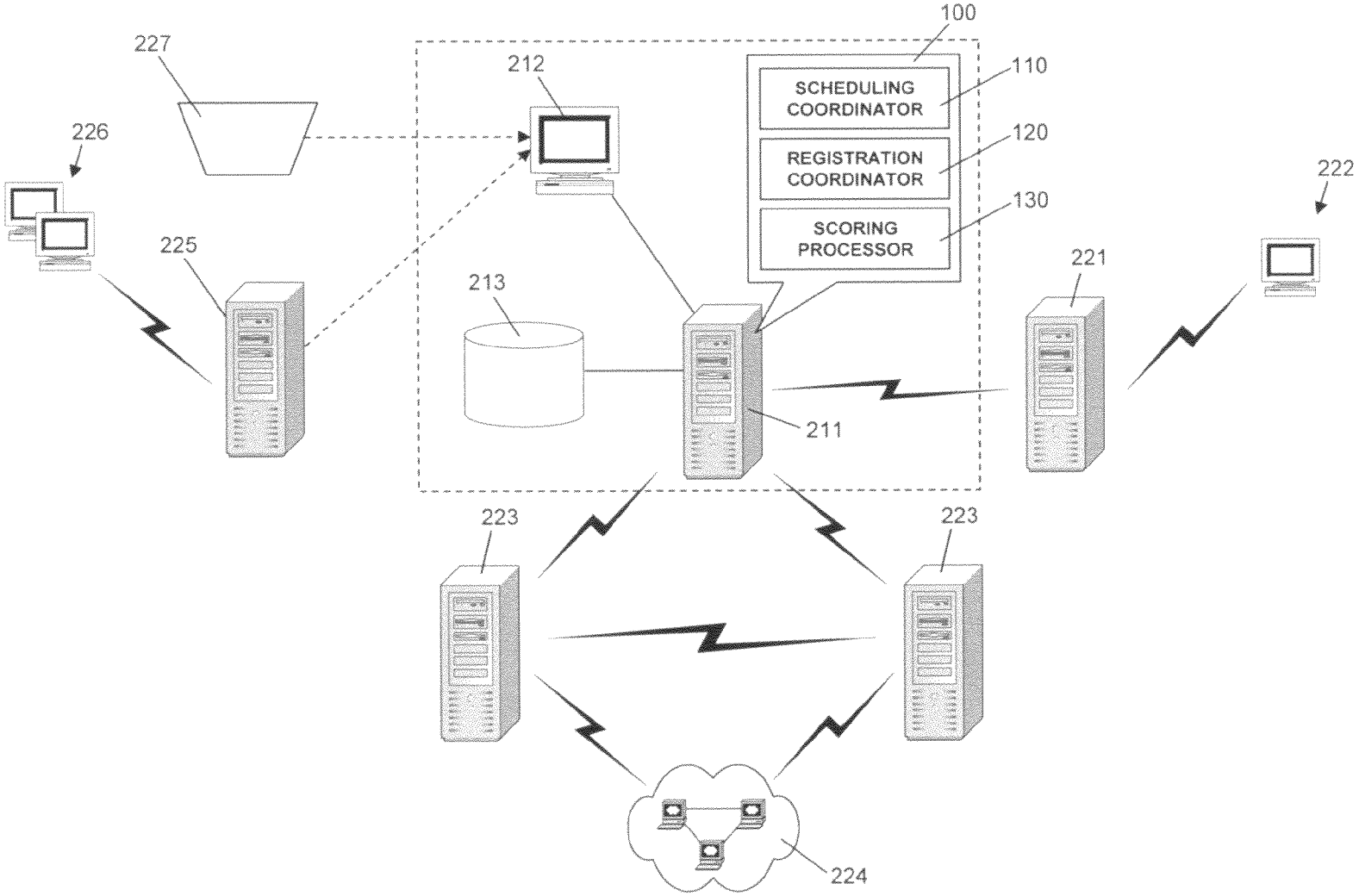
FIG. 3 illustrates a hardware and network system for an exemplary embodiment of an event management architecture.

Illustrating an exemplary hardware system, FIG. 3 shows that the EMA 100 may include a computer server 211, a database 213, and a graphical user interface 212. In this example, processing by the scheduling coordinator 110, the registration coordinator 120, and the scoring processor 130 occurs when the computer server 211 executes corresponding stored instructions, e.g. software. Alternative embodiments may employ more than one computer server 211 arranged in a distributed processing environment. The database 213 stores data processed by the scheduling coordinator 110, the registration coordinator 120, and the scoring processor 130. The graphical user interface 212 enables individuals, e.g. administrators, to monitor and/or control the computer server 211 and to view data stored in database 213. In general, the graphical user interface 212 permits individuals to configure, monitor, and operate the EMA 100. The EMA 100 may display a variety of data regarding the gaming event, including a sub-event guide, via the interface 212, as well as other displays that are connected to the EMA system 100.

The EMA 100 may interface with a variety of sub-event systems. For example, as further illustrated in FIG. 3, the EMA 100 interfaces with sub-event system servers 221, 223, and 225, which are computers employed to execute any number and type of electronic sub-events. The sub-event server 221 is a computer that is connected directly to the EMA server 211. The server 221 is also connected directly to a terminal 222 which enables an individual to participate in one or more sub-events served by the server 221. In one embodiment, the server 221 and the terminal 222 may also represent a single integrated system, such as a video game machine. On the other hand, the sub-event servers 223 represent a plurality of computers in a distributed processing architecture which communicates electronically with terminals 224 in a networked environment, such as the Internet. As such, any terminal 224 connected to the networked environment may participate in one or more sub-events served by the servers 223. Meanwhile, the sub-event server 225 is a computer that is not electronically connected to the EMA server 211. Although the server 225 electronically serves one or more sub-events 2 to terminals 226, data and results for sub-events from the server 226 are communicated to the EMA 100 by manual input into the graphical user interface 212, rather than by direct electronic transmission to the server 211.

Although sub-events, such as video games running on a computer system, may be electronic, sub-events may also be non-electronic. Accordingly, FIG. 3 also illustrates a non-electronic process 227 which provides a sub-event. In other words, the sub-event may be managed manually through the process 227. Data and results for sub-events occurring through the process 227 may be communicated to the EMA 100 by manual input into the graphical user interface 212, rather than by direct electronic transmission to the server 211.

Individuals may participate in sub-events through an integrated sub-event system. In such an arrangement, sub-events are integrated with the EMA 100 when the sub-events are created and developed. As a result, the sub-events do not have to be subsequently modified to be compatible with the functionality of the EMA 100. For example, the sub-events in an integrated sub-event system may all share a standard scoring scheme with the EMA 100, so that the scoring processor 130 is not required to convert scores from those sub-events into a standard format. Advantageously, integration also enables the sub-events to share common resources, such as software modules. The integration of sub-events with the EMA 100 is facilitated by employing a sub-event server, such as servers 221 and 223, which are electronically networked with the EMA server 211. Of course, while FIG. 3 shows that the sub-event servers 221 and 223 are physically separate from the EMA server 211, in other embodiments the same set of computing machines may act both as the EMA server 211 and the sub-event server 221 or 223.

Sub-events may also be provided through non-integrated "standalone" systems, where the sub-events are not standardized with other sub-events and require additional processing or modification to be compatible with the EMA 100. For example, systems, such as server 225 and sub-event process 227, which are not electronically networked with the EMA 100, are less likely to be a part of an integrated sub-event system, as they do not share resources provided by the server 211 making standardization more difficult. Moreover, additional processing is required to enable communication between the EMA 100 and the standalone server 221. However, as discussed in detail herein, an advantage of embodiments of the present invention is that they are able to include standalone sub-events in gaming events.

Figure 4A:
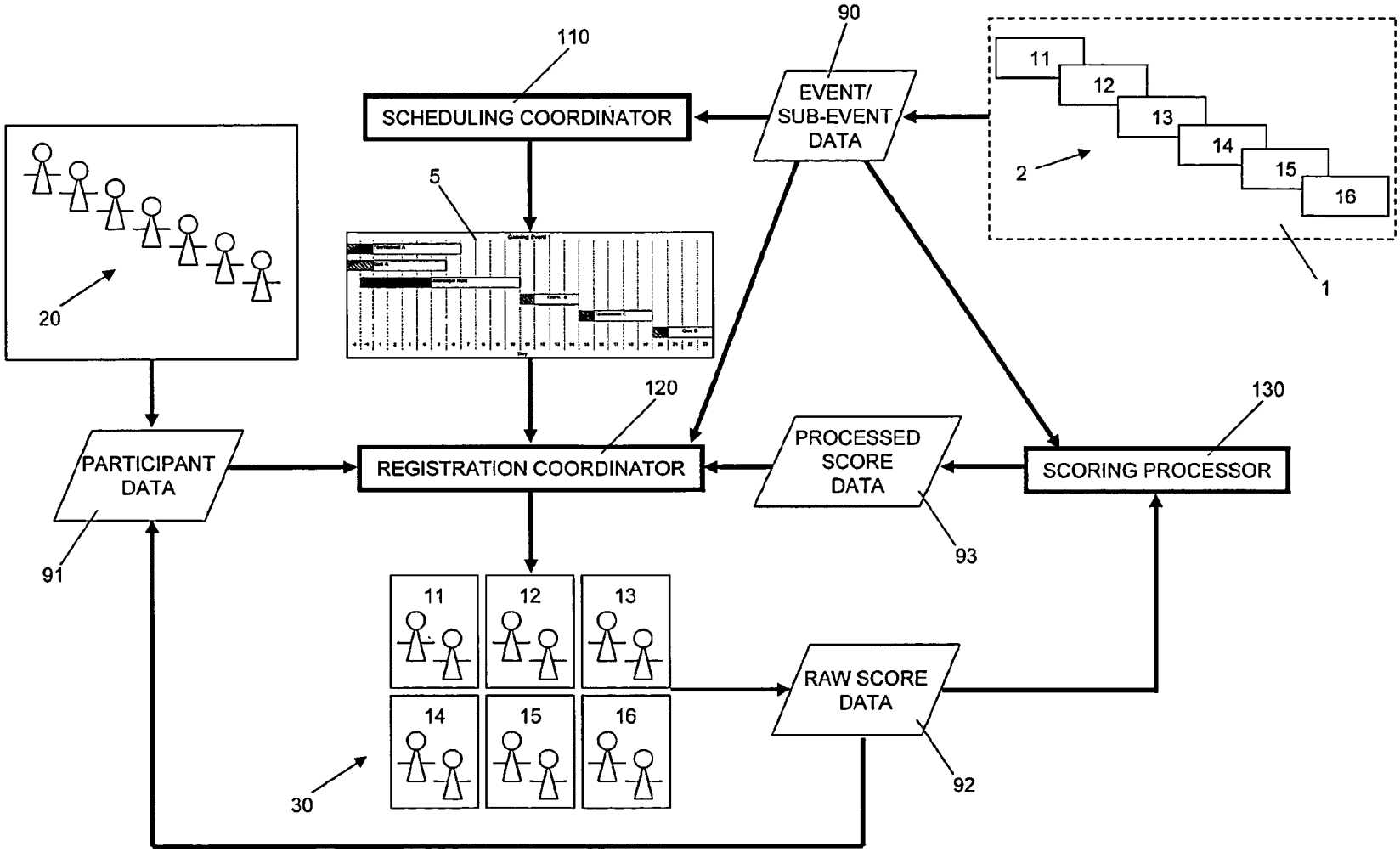
FIG. 4A illustrates an operational diagram for an exemplary embodiment of an event management architecture.

FIG. 4A illustrates the operation of the EMA 100. Initially, as shown in FIG. 1, a gaming event 1 is defined by the selection of a set of sub-events 2. Although FIG. 1 specifically shows the sub-events 11, 12, 13, 14, 15, and 16, it is understood that the gaming event 1 may include any number and any type of sub-events 2.

As FIG. 4A shows, the sub-events 2 making up the gaming event 1 are associated with event/sub-event data 90. The data 90 includes information that defines and characterizes the sub-events 2, as well as the gaming event 1 in general. This information is employed by the EMA 100 to manage the sub-events 2. As discussed previously, information may be transmitted to the EMA 100 through a variety of techniques, including electronic communications or by entry into the graphical user interface 212 shown in FIG. 3. In particular, as described in detail below, elements of the data 90 are received as input by the scheduling coordinator 110, the registration coordinator 120, and the scoring processor 130.

TABLE 1 provides examples of information that may be included in the data 90.

TABLE 1

| Sub-event | Game Type | Time Interval | Participation Prerequisite? | Score Prerequisite? |
|---|---|---|---|---|
| 11 | Tournament A | 6 days | No | No |
| 12 | Quiz A | 5 days | No | No |
| 13 | Scavenger Hunt | 6 days | No | No |
| 14 | Tournament B | 3 days | Yes, must complete sub-events 11, 12, and 13 | No |
| 15 | Tournament C | 4 days | Yes, must complete sub-event 11 and either sub-event 12 or 13 | Yes, must be among top-scoring 500 participants with pooled scores after completion of sub-event 11 and either 12 or 13 |
| 16 | Quiz B | 3 days | Yes, must complete sub-events 14 and 15 | Yes, must be among top-scoring 100 participants with pooled scores from completion of sub-events 14 and 15 |

Figure 4B:
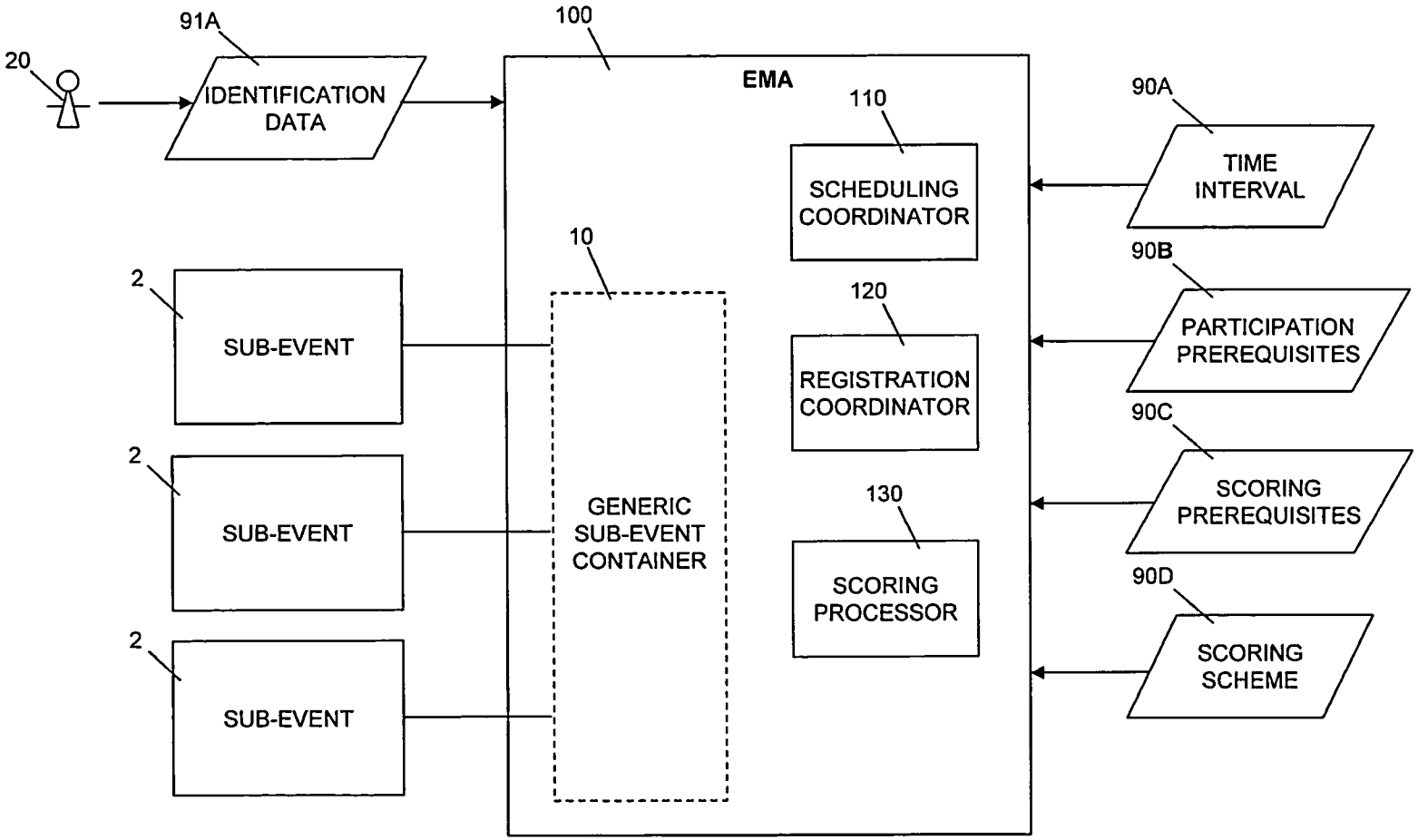
FIG. 4B illustrates a further operational diagram for an exemplary embodiment of an event management architecture employing a generic sub-event container.

Using the exemplary information of TABLE 1, the EMA 100 shown in FIG. 4B receives time interval data 90A for each of the sub-events 2. The time interval of a sub-event 2 determines how much time the scheduling coordinator 110 of the EMA 100 schedules for the sub-event 2 to take place during the gaming event 1.

Figure 5:
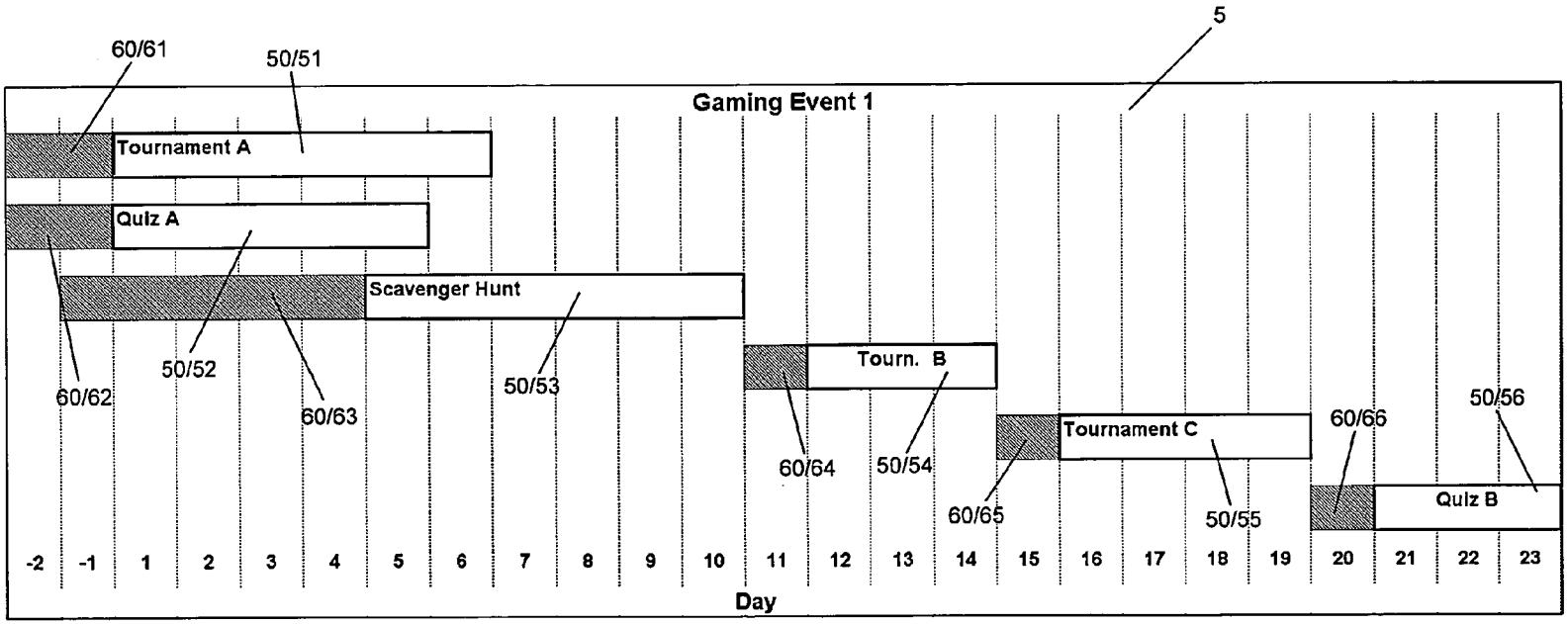
FIG. 5 illustrates an example of a schedule for a gaming event having a plurality of sub-events of varying types.

Using the input from data 90, the scheduling coordinator 110 determines a gaming event schedule 5, as illustrated in FIG. 5, so that participants can complete the sub-events 2 in appropriate order. The gaming event schedule 5 indicates how the sub-events 2 are arranged and when each sub-event 2 begins and ends. The start and the end of each sub-event 2 are indicated on the schedule 5 by the time intervals 50. The scheduling coordinator 110 ensures that the schedule 5 allots sufficient time for each sub-event 2 to take place over the time interval 50.

In accordance with the exemplary data of TABLE 1, schedule 5 of FIG. 5 shows that the sub-event 11 has a time interval 51 of 6 days. Additionally, the schedule 5 shows that: the sub-event 12 has a time interval 52 of 5 days; the sub-event 13 has a time interval 53 of 6 days; the sub-event 14 has a time interval 54 of 3 days; the sub-event 15 has a time interval 55 of 4 days; and the sub-event 16 has a time interval 56 of 3 days. In general, the length of the time interval specified for a sub-event may vary and may depend on the set of rules for the sub-event. The time interval for a sub-event provides sufficient time to allow participants to complete the sub-event. Although the time interval data in TABLE 1 is provided in terms of days, the data may be measured in any unit of time, e.g. minutes, hours, days, etc.

In some cases, in order to complete a sub-event, an individual may need to participate in the sub-event throughout the entire given time interval for the sub-event. For instance, a sub-event having a tournament format, such as sub-events 11, 14, and 15 of FIG. 5, may require an individual to participate in a series of games scheduled periodically over the entire sub-event interval. In other cases, participants may only need a portion of the entire time interval to complete the sub-event, and the only requirement is that they must complete the sub-event at some point before the end of the sub-event interval. For instance, a sub-event having a quiz format, such as sub-events 12 and 16 in FIG. 5, may have a sub-event interval of several days, but participants may be able to complete the quiz in a matter of a few minutes or hours. In general, a sub-event may be scheduled concurrently with other sub-events, as long as sufficient time is provided to complete the concurrent sub-events. For example in FIG. 5, an individual may complete sub-events 11, 12, and 13 even through their time intervals are scheduled to overlap.

Using the exemplary data of TABLE 1, the EMA 100 may additionally receive information 90B regarding different participation prerequisites, or criteria, for the sub-events 2, as shown in FIG. 4B. In particular, the information 90B may include the dependencies between sub-events 11, 12, 13, 14, 15, and 16. In some cases, sub-events may require participants to complete one or more previous sub-events. Such prerequisites may affect how the scheduling coordinator 110 schedules the time intervals for the sub-events. In other words, the scheduling coordinator 110 ensures any dependent sub-events begin only after the sub-events on which they depend have ended. In this way, participants are able to complete the sub-events that make them eligible to participate in dependent sub-events.

As TABLE 1 indicates, participants for sub-events 11, 12, and 13 do not have to complete any previous events. In other words, sub-events 11, 12, and 13 have no participation prerequisites and are independent sub-events. As such, the scheduling coordinator 110 may schedule the time intervals 51, 52, and 53 for sub-events 11, 12, and 13, as shown in FIG. 5, without having to consider whether any prior sub-events have been scheduled.

On the other hand, participants for sub-events 14, 15, and 16 must complete one or more prerequisite sub-events 20. In other words, sub-events 14, 15, and 16 have participation prerequisites and are dependent events. As such, the scheduling of the time intervals 54, 55, and 56 for sub-events 14, 15, and 16 depends on the prerequisite sub-events.

In particular, participants of sub-event 14 must complete sub-events 11, 12, and 13. Due to these prerequisites, the scheduling coordinator 110 may schedule the respective time intervals 51, 52, and 53 for sub-events 11, 12, and 13 as shown in FIG. 5, so that the time intervals 51, 52, and 53 end before the start of the time interval 54 for sub-event 14. Due to the participation requirements for sub-event 14, an individual must be able to complete all sub-events 11, 12, and 13. Therefore, the scheduling coordinator 110 must receive information in data 90 that indicates that sub-events 11, 12, and 13 can all be completed if scheduled concurrently.

Meanwhile, participants of sub-event 15 must complete sub-event 11 in combination with either sub-event 12 or sub-event 13. Accordingly, the scheduling coordinator 110 may schedule the respective time intervals 51, 52, and 53 for sub-events 11, 12, and 13 as shown in FIG. 5, so that the time intervals 51, 52, and 53 end before the start of the time interval 55 for sub-event 15. Due to the participation requirements for sub-event 15, the scheduling coordinator 110 must receive information in data 90 that indicates that sub-events 11 and either sub-event 12 or 13 can be completed if scheduled concurrently.

Similarly, participants of sub-event 16 must complete sub-events 14 and 15. Sub-event 16 is dependent on sub-events 14 and 15, which as described previously, have their own dependencies on sub-events 11, 12, and 13. Therefore, the scheduling coordinator 110 may schedule the respective time intervals 54 and 55 for sub-events 14 and 15 as shown in FIG. 5, so that the time intervals 54 and 55, as well as time intervals 51, 52, and 53, end before the start of the time interval 56 for sub-event 16. Due to the participation requirements for sub-event 16, the scheduling coordinator 110 must receive information in data 90 that indicates that sub-events 14 and 15 can be completed if scheduled concurrently.

In the example above, data 90 includes information regarding time intervals and participation prerequisites for the sub-events 2. If data 90 does not include other scheduling requirements, the scheduling coordinator 110 may freely set the start of each time interval 51, 52, 53, 54, 55, and 56 as illustrated in FIG. 5, in order to satisfy the time interval requirements and participation prerequisites provided in data 90A and 90B.

However, in alternative gaming events, the data 90 may contain other information that affects how the scheduling coordinator 110 arranges the sub-events 2 within the schedule 5. In addition to the time interval information for the sub-events 2, the data 90 may also indicate when the time intervals for the sub-events 2 are required to begin, thereby fixing the time intervals within the schedule 5. For instance, in accordance with the schedule 5 shown in FIG. 5, sub-events 11 and 12 may be required to begin on day 1, sub-event 13 to begin on day 5, sub-event 14 to begin on day 12, sub-event 15 to begin on day 16, and sub-event 16 to begin on day 21. Additionally, the data 90 may also require that the gaming event 1 have a specific gaming event time interval. As illustrated by schedule 5 of FIG. 5, the gaming event 1 has a gaming time event of twenty-three days. Therefore, the scheduling coordinator 110 would schedule all time intervals 50 for the sub-events 2 to begin and end within the gaming event time interval of twenty-three days. If there are conflicts between scheduling requirements provided in data 90, the scheduling requirements may be prioritized so that the scheduling coordinator 110 may resolve any conflicts by selecting the requirement with higher priority.

FIG. 4A also shows a pool of participants 20 who may be included in any one of the sub-events 2 depending on the eligibility requirements, or criteria, for each sub-event 2. The pool of participants, for example, may be registered members of an online gaming community that employs the EMA 100 to manage gaming events.

Once the scheduling coordinator 110 determines the schedule 5, the registration coordinator 120 registers, or enrolls, participants 20 for each sub-event 2. A participant 20 for a particular sub-event 2 may be an individual or a team of individuals, depending on the set of rules for that sub-event 2. As shown in FIG. 4A, participant data 91 is associated with the pool of participants 20. As shown in FIG. 4B, the EMA 100 may receive participant data 91, which includes identification information 91A for each participant 20, such as an individual's name, a team name, a special identification number, or the like. The EMA 100 may use the identification information 91A to index and track information corresponding to each participant 20.

Before registering participants 20 for each sub-event 2, the registration coordinator 120 determines which participants 20 are eligible to participate in each sub-event 2. To do so, the registration coordinator 120 of the EMA 100 receives information from the event/sub-event data 90 which provides information regarding registration requirements, or criteria. As discussed previously, the information in TABLE 1 provides examples of participation criteria 90B that may be included in the data 90. The participation criteria are employed by the registration coordinator 120, as well as the scheduling coordinator 110.

As shown in FIG. 4B, the EMA 100 may also receive information from the data 90 regarding any scoring requirements, or criteria, 90C for the prerequisite sub-events. Examples of scoring prerequisites are provided in TABLE 1. In general, scoring criteria 90C for a sub-event 2 provides that participants 20 are only eligible for the sub-event 2 if they receive a particular score or ranking from their participation in one or more prerequisite sub-events.

As TABLE 1 indicates, participants for sub-events 11, 12, and 13 do not have to complete any previous events. As such, the registration coordinator 120 may register any participants 20 for sub-events 11, 12, and 13, regardless of whether the participants 20 have completed any prior sub-events.

On the other hand, participants for sub-events 14, 15, and 16 must complete one or more prerequisite sub-events. As a result, the registration coordinator 120 may only consider participants 20 who have completed the appropriate prerequisite sub-events.

In particular, participants of sub-event 14 must complete sub-events 11, 12, and 13. Due to these criteria, the registration coordinator 120 only considers participants 20 who have completed sub-events 11, 12, and 13. It is not known which participants 20 have completed the prerequisite sub-events 11, 12, and 13 until the time intervals for the sub-events 11, 12, and 13 have ended according to schedule 5 shown in FIG. 5. Therefore, the registration coordinator 120 does not evaluate the eligibility of participants 20 for sub-event 14 until the time intervals for the sub-events 11, 12, and 13 have ended.

As shown in TABLE 1, participants of sub-event 15 must complete sub-event 11 in combination with either sub-event 12 or sub-event 13. Accordingly, the registration coordinator 120 only considers participants 20 who have completed sub-event 11 in combination with either sub-event 12 or sub-event 13. Moreover, the registration coordinator 120 does not evaluate the eligibility of participants 20 for sub-event 14 until the time intervals for the sub-events 11, 12, and 13 have ended.

In addition, participants of sub-event 16 must complete sub-events 14 and 15. Therefore, the registration coordinator 120 only considers participants 20 who have completed sub-events 14 and 15. Furthermore, the registration coordinator 120 does not evaluate the eligibility of participants 20 for sub-event 16 until the time intervals for the sub-events 14 and 15 have ended.

Each participant 20 typically receives some type of score after completing each sub-event 2. As an example, the EMA 100 may employ a scoring scheme that uses at least one of the following scoring indicators: event score, percentile placement, and absolute rank position. The event score provides a value based typically on accumulated points where the highest value from the entire range of event scores from all participants is the best score. Percentile placement provides an overall percentile placement where a score of 99% represents placement in the top 1% of scored values. Absolute rank position provides a ranking relative to other participants in descending order from the participant with the best score. However, it is understood that other scoring indicators may be used by the EMA 100.

Scores may be employed by the EMA 100 to determine eligibility for dependent sub-events. In other words, participants 20 for a dependent sub-event may have to satisfy scoring prerequisites as well as participation prerequisites. Examples of scoring prerequisites are provided in TABLE 1.

As discussed previously, participants for sub-events 11, 12, and 13 do not have to complete any previous events. Correspondingly, TABLE 1 indicates that there are no scoring prerequisites for participation in sub-events 11, 12, and 13. Thus, the registration coordinator 120 may register any participants 20 for sub-events 11, 12, and 13, regardless of whether the participants 20 have completed or received scores in any prior sub-events.

While participants 20 of sub-event 14 must complete sub-events 11, 12, and 13, TABLE 1 indicates that there are no scoring prerequisites for sub-event 14. Accordingly, the registration coordinator 120 determines participants 20 to be eligible for sub-event 14 as long as they complete all sub-events, regardless of the scores they may receive.

On the other hand, TABLE 1 shows that there are scoring prerequisites for sub-events 15 and 16. In particular, to be eligible for sub-event 15, participants 20 must not only complete sub-event 11 in combination with either sub-event 12 or sub-event 13, but must also be ranked among the top-scoring 500 participants with combined scores from sub-event 11 and either sub-event 12 or sub-event 13. In other words, the two scores that an individual receives from sub-event 11 and either sub-event 12 or sub-event 13 are combined and ranked with the similarly combined scores from other participants of the prerequisite sub-events. Likewise, as indicated in TABLE 1, in order to be eligible for sub-event 16, participants 20 must not only complete sub-events 14 and 15, but must also have a combined score from sub-events 14 and 15 that ranks among the top 100 similarly combined scores which are pooled from the participants 20 of the prerequisite sub-events. Therefore, for sub-events 15 and 16, the registration coordinator 120 evaluates the ranking of scores combined from prerequisite sub-events to determine which individuals are eligible to participate.

Accordingly, the registration coordinator 120 initially registers participants 20 for the independent sub-events and operates throughout the gaming event 1 to further register participants 20 as prerequisite sub-events are completed. Where scoring prerequisites are specified, the registration coordinator 120 must evaluate scores from prerequisite sub-events.

As illustrated by the examples above, the eligibility, or qualification, conditions for participation in a dependent sub-event may require that i) one of the requirements must be met, ii) all the requirements must be met, or iii) specific sub-event requirements must be met. When one of the criteria must be met, an individual qualifies for the given dependent sub-event by qualifying and participating in one of the listed prerequisite sub-events. When all the criteria must be met, an individual qualifies for the given dependent sub-event by qualifying and participating in each of the listed prerequisite sub-events. When specific event criteria must be met, an individual qualifies for participation in the given dependent sub-event by qualifying, participating, and meeting corresponding requirements, e.g. scoring requirements, in the listed prerequisite sub-events.

Figure 6A:
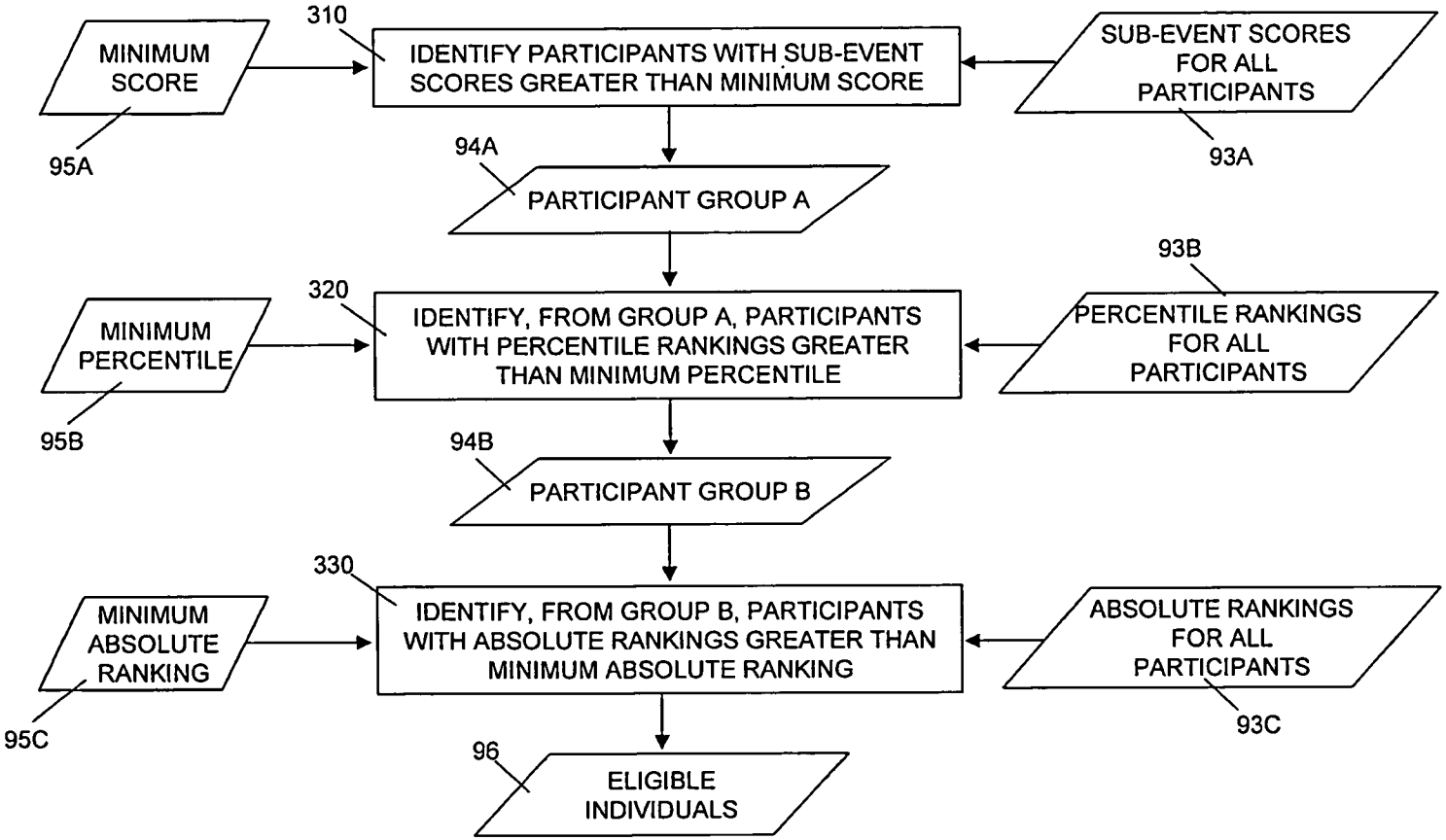
FIG. 6A illustrates a scoring scheme for an exemplary embodiment of an event management architecture.

For example, in one embodiment, scoring prerequisites for a dependent sub-event may require that an individual participate in a prerequisite sub-event and achieve a minimum sub-event score, a minimum percentile ranking, and/or a minimum absolute ranking. As illustrated in FIG. 6A, the EMA 100 may apply all of these qualification criteria in a particular order to determine whether the individual is eligible to participate in the dependent sub-event. Steps 310, 320, and 330 may be executed by the registration coordinator 220. FIG. 6A shows that steps 310, 320, and 330 receive sub-event scores 93A, percentile rankings 93B, and absolute rankings 93C, respectively, for all the participants 20 in the prerequisite sub-event. The sub-event scores 93A, percentile rankings 93B, and absolute rankings 93C are provided generally in the processed score data 93 from the scoring processor 130. The processed score data 93 is described in further detail below. Step 310 identifies participants 20, making up participant group A (identified by the reference numeral 94A) who have a sub-event score 93A that is greater than a predetermined minimum score 95A. Step 320 then identifies participants 20 from group A who have a percentile ranking greater than a predetermined minimum percentile 95B. Step 320 produces participant group B (identified by the reference numeral 94B). Step 330 then identifies participants 20 from group B who have absolute rankings greater than a predetermined minimum absolute ranking 95C.

Note that if the steps 310, 320, and 330 are all programmed instructions in a routine executed by the EMA 100, the minimum score 95A may be set to zero to eliminate any evaluation according to the sub-event score 93A. Likewise, the minimum percentile 95B may be set to zero to eliminate any evaluation according to the percentile rankings 93B. By setting both the minimum score 95A and the minimum percentile 95B to zero, the participants 20 are evaluated only according to the minimum absolute ranking 95C.

Figure 6B:
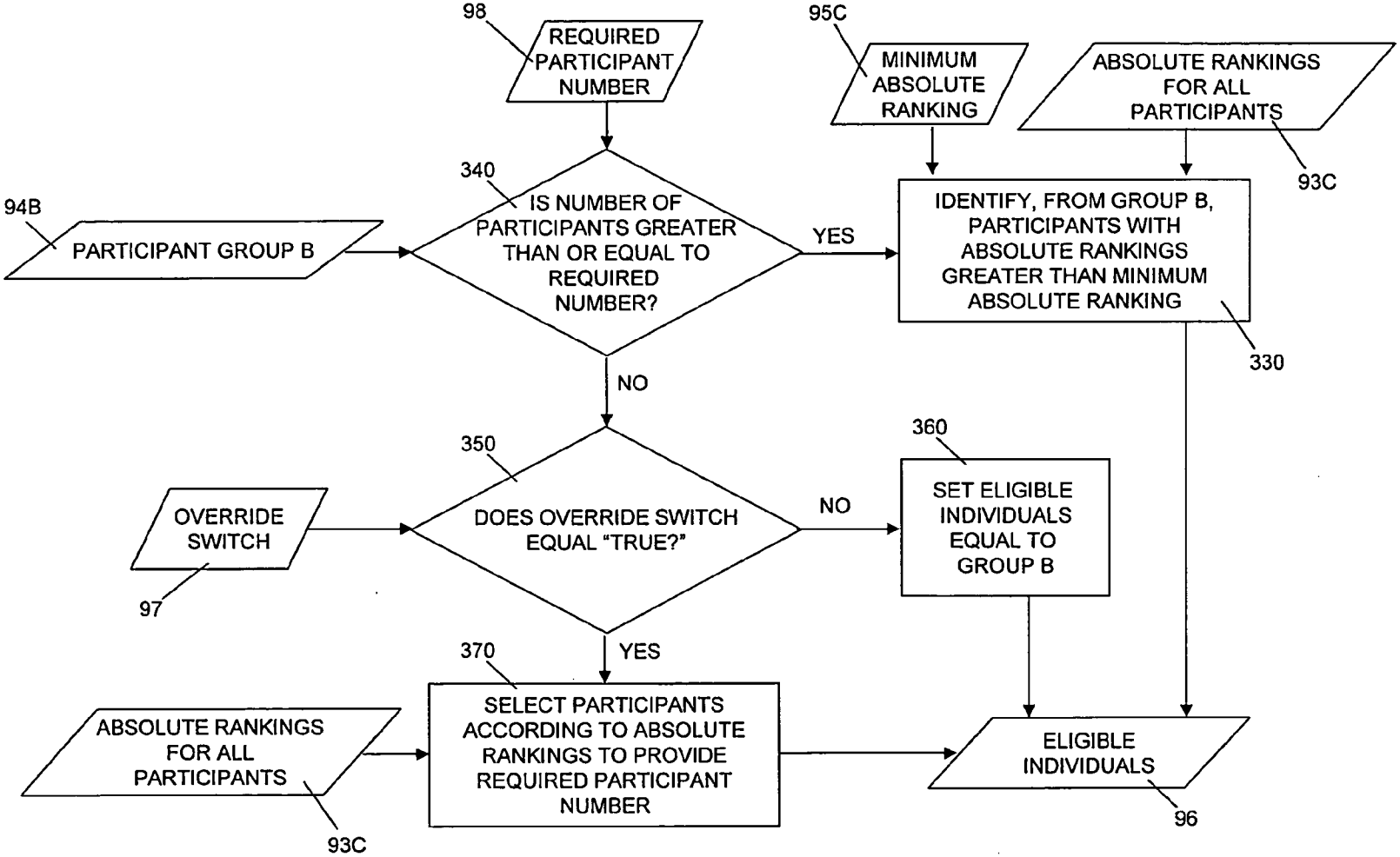
FIG. 6B illustrates another scoring scheme for an exemplary embodiment of an event management architecture.

As illustrated in the alternative embodiment of FIG. 6B, the EMA 100 may also employ an override switch 97, in case a fixed number of individuals 98 is required for a particular dependent sub-event, but an insufficient number of participants 20 qualify with the application of steps 310 and 320. Steps 310 and 320 are applied as in the embodiment of FIG. 6A to produce the participant group B (identified by the reference numeral 94B). In this alternative embodiment, however, the participant group B is then evaluated in step 340 to determine if the number of individuals in participant group B is greater than or equal to a required participant number 98. If the number of individuals in participant group B is greater than or equal to a required participant number 98, the process proceeds to step 330 as described previously in FIG. 6A. On the other hand, if the number of individuals in participant group B 94B is less than the required participant number 98, step 350 determines whether the override switch is set to "TRUE." If the override switch 97 is set to "FALSE," step 360 sets the group of eligible individuals for the dependent sub-event equal to the participant group B. If the override switch is set to "TRUE," step 370 adds participants 20 to reach the required participant number 98 by identifying a sufficient number of participants 20 who have the highest absolute rankings but who have not yet been deemed eligible after the application of steps 310 and 320.

As FIG. 4A illustrates, a scoring processor 130 may be employed by the EMA 100 to process scores from prerequisite sub-events for use by the registration coordinator 120. In particular, once the time interval for a prerequisite sub-event ends according to the schedule 5, the completed sub-event 30 provides the scoring processor 130 a raw score 92 for each participant 20. If necessary, the scoring processor 130 then converts the raw scores 92 into a standard format to facilitate evaluation by the registration coordinator 120.

In an alternative embodiment, the sub-event system itself is responsible for converting the raw scores 92 into a standard format which is compatible with the EMA 100. As such, an aspect of the scoring processor 130 would be a part of the overall system, but would reside with the sub-event system.

As also shown in FIG. 4B, the EMA 100 receives information 90D regarding the scoring scheme for each sub-event 2. As described previously, the set of rules, which includes a scoring scheme, may vary for each sub-event in a gaming event. As such, FIG. 4A shows that sub-events 2 may produce raw scores 92 according to very different scoring schemes. As a result, the raw score data 92 produced between different sub-events 2 may not be immediately comparable or combinable. Accordingly, the scoring processor 130 may convert the raw score data 92 into a single standard format employed by the EMA 100. In general, this conversion enables compatibility between each sub-event and a scoring scheme of the EMA 100. In other words, each sub-event is permitted to employ its own scoring method, no matter how idiosyncratic, as long as the scoring processor 130 has a way to convert the score. Of course, a sub-event may directly employ the scoring system of the EMA 100, for example in an integrated sub-event system, so that score conversion is not necessary.

As a part of producing the processed score data 93, the scoring processor 130 may need to normalize the raw score data 92. For instance, as discussed previously, the sub-event 11 has a scoring prerequisite that provides that to be eligible participants 20 must be ranked among the top-scoring 500 participants with combined scores from sub-event 11 and either sub-event 12 or sub-event 13. However, the game type for sub-event 11 is Tournament A, the game type for sub-event 12 is Quiz A, and the game type for sub-event 13 is Scavenger Hunt. The different game types for sub-events 11, 12, and 13 all have different sets of rules and scoring schemes. In one aspect, the raw scores 92 produced by the sub-events 11, 12, and 13 may not reflect the relative differences in difficulty between the sub-events. For instance, sub-event 12, with game type Quiz A, may provide a raw score 92 equal to the number of correct answers provided out of one hundred quiz questions. Meanwhile, sub-event 11 with game type Tournament A may provide ten points for every tournament game won for a maximum of fifty points. In this example, getting fifty quiz questions correct in sub-event 12 may yield the same number of points as winning all five possible games in sub-event 11, but may be significantly easier than winning the five tournament games. A direct comparison of raw scores 92 between sub-event 11 and sub-event 12 fails to indicate that sub-event 11 is more difficult than sub-event 12. Thus, before a score from sub-event 11 is combined with a score from sub-event 12, the score from sub-event 11 is preferably multiplied by a pre-determined weighting factor, e.g. a factor of two, which reflects the relative difficulty. A similar weighting factor may be applied with respect to sub-event 13 in order to reflect the relative difficulty of completing sub-event 13. Once the scoring processor 130 normalizes the raw scores 92 by such a weighting process, the scoring processor 130 may also add the normalized score from sub-event 11 for each individual to the individual's respective normalized score from either sub-event 12 or sub-event 13. The combined score is pooled and ranked with the combined scores of other participants, thus producing the processed score data 93. As shown in FIG. 4A, the registration coordinator 120 receives the processed score data 93 to determine eligibility for sub-event 15 as discussed above.

As illustrated in the examples above, embodiments of the present invention may employ several approaches for determining whether an individual is eligible to participate in a dependent sub-event. One approach simply requires successful completion of a prerequisite sub-event. Another approach requires pooling an individual's performance across more than one selected prerequisite sub-event, without applying any weighting factors. The scoring processor 130 may combine or average the scores from each prerequisite sub-event. The resulting score may be used to determine a percentile ranking as well as an absolute ranking relative to all the candidate participants. A further approach pools an individual's performance across more than one selected prerequisite sub-event, after applying weighting factors corresponding to the prerequisite sub-events. As discussed in the example above, predetermined weighting factors account for the relative importance or difficulty between the prerequisite sub-events. The weighting factors are applied to the prerequisite sub-event scores before the scores are combined or averaged and used to determine a percentile ranking as well as an absolute ranking relative to all the candidate participants.

As the registration of participants 20 for a particular sub-event may depend on the results of prior sub-events to determine whether prerequisites have been satisfied for eligibility, the registration coordinator 120 does not begin registering participants 20 for the dependent sub-event until the prerequisite sub-events have been completed. Moreover, the registration coordinator 120 may require some time to register participants 20 for the dependent sub-event. For instance, a certain amount of time may be required to receive requests from participants 20 who choose to participate in the sub-event. Of course, in alternative cases, participants 20 of the prerequisites sub-events may be automatically evaluated for eligibility and registered in the dependent sub-event once the prerequisites sub-events have been completed. At the very least, the registration coordinator 120 may require time to collect and process data regarding eligibility and to inform participants 20 of their eligibility in advance of the start of the dependent sub-event. As such, the scheduling coordinator 110 may also schedule time intervals specifically for the registration process.

Accordingly, FIG. 5 also shows that the gaming event schedule 5 includes registration intervals 51, 52, 53, 54, 55, and 56 for sub-events 11, 12, 13, 14, 15, and 16, respectively. For the independent sub-events 11, 12, and 13, which have no prerequisites for eligibility, the registration intervals 51, 52, and 53 may begin at any time before the sub-events 11, 12, and 13 and may occur while other sub-event or registration intervals are taking place. FIG. 5 shows that the registration intervals 51 and 52 for sub-events 11 and 12 begin two days before the start of the sub-events 11 and 12 on the first day of the gaming event 1. Meanwhile, the registration interval 53 for sub-event 13 begins five days before the sub-event 13 begins on the fifth day of the gaming event 1. Moreover, the registration interval 53 also overlaps with the registration intervals 51 and 52 as well as the sub-events 11 and 12. On the other hand, for dependent sub-events 14, 15, and 16, which depend on the completion of prerequisite sub-events, the registration intervals 54, 55, and 56 do not begin until the prerequisite events have been completed. For sub-events 14 and 15, the corresponding registration intervals 54 and 55 do not begin until prerequisite sub-events 11, 12, and 13 have completed. Similarly, for sub-event 16, the registration interval 56 does not begin until prerequisite sub-events 14 and 15 have completed.

Therefore, to summarize operation of the EMA 100, the scheduling coordinator 110 arranges the sub-events according to scheduling criteria, such as sub-event intervals and participation prerequisites. The registration coordinator initially registers participants for independent sub-events during a scheduled registration interval, and the independent sub-events may begin as scheduled by the scheduling coordinator 110. When the scheduled sub-event interval of each independent sub-event ends, the results from the sub-event are received by the scoring processor 130, which processes the results for use by the registration coordinator 120. At the very least, the results indicate whether each participant has completed the sub-event. Typically, as shown in FIG. 4A, the results include a raw score 92 for each participant 20, where the score measures how well the participant completed the sub-event. The scoring processor 120 processes the raw score data 92 into processed score data 93. As the initial independent sub-events are completed, during scheduled registration intervals, the registration coordinator 120, based on participation and scoring prerequisites, registers participants 20 for the sub-events that depend on the independent sub-events. Once registration is completed, the corresponding dependent sub-events begin. As dependent sub-events are completed, the scoring processor 130 processes the results, and registration coordinator 120, as scheduled, registers participants 20 for further dependent sub-events according to participation and scoring prerequisites. This process continues until all sub-events have been completed to end the gaming event.

The EMA 100 may be used as a foundation to simplify the development of sub-events, as well as larger gaming events. The development of a new sub-event may be streamlined and facilitated by initially incorporating functionality that has already been developed for the EMA 100. This approach minimizes the need to repeat development of the same services or components for each sub-event. It is understood, however, that each sub-event does not have to be created or developed with the initial intention of working within an EMA framework. In such a case, the sub-event may be modified, or retrofitted, to take advantage of EMA facilities. Typically, the sub-event may be modified to include additional functionality that enables the sub-event to interact with EMA registration, scheduling, scoring, and other EMA functionality. In general, the EMA 100 supports interoperability with any sub-event, whether or not, for instance, the sub-event is initially planned for operation with the EMA or operates on a standalone system.

Advantageously, if sub-events are developed integrally with the EMA 100, the EMA 100 may automatically and flexibly schedule the sub-events to comply with the participation prerequisites. In other words, such integration facilitates synchronization between the sub-events and the EMA 100. However, if a sub-event occurs through a standalone system, the EMA may require additional synchronization steps to ensure that the standalone sub-event starts and ends in the appropriate sequence relative to the other sub-events in the gaming event. For instance, data regarding the standalone sub-event, including scheduling data, may be entered through the EMA interface 212 illustrated in FIG. 3. Once the EMA receives the data, the EMA determines whether the scheduling data of the standalone sub-event conflicts with the participation prerequisites and the scheduling of the other sub-events. If possible, the EMA 100 may automatically resolve a conflict by adjusting the scheduling of other sub-events. If such a resolution is not possible, the standalone event is not scheduled and the EMA 100 indicates that there is a conflict that must be resolved by an administrator.

To enable scalable management of many sub-events of varying types in complex arrangements, the EMA 100 may manage pluralities of sub-events via a generic sub-event containers. In general, a single generic sub-event container allows a plurality of sub-events to be logically grouped according to their common characteristics or functionality requirements. Instead of managing each sub-event on an individual basis, the EMA 100 may work with a single generic sub-event container to manage similar sub-events or to provide the same functionality to more than one sub-event. As such, generic containers also promote standardization in the management of sub-events. The EMA 100 may allow sub-event containers 10 to be defined and managed through the graphical user interface 212 shown in FIG. 3. Illustrating an example, FIG. 4B shows that a plurality of sub-events 2 are associated with a generic sub-event container 10, and as a result, the EMA 100 can manage the sub-events 2 via the generic sub-event container 10.

The EMA 100 may employ a plurality of generic sub-event containers which are defined according to more than one group of sub-events. However, because a generic sub-event container generally has a 1:N relationship with sub-events, working with any number of generic containers should be simpler than managing each sub-event individually.

Figure 7A:
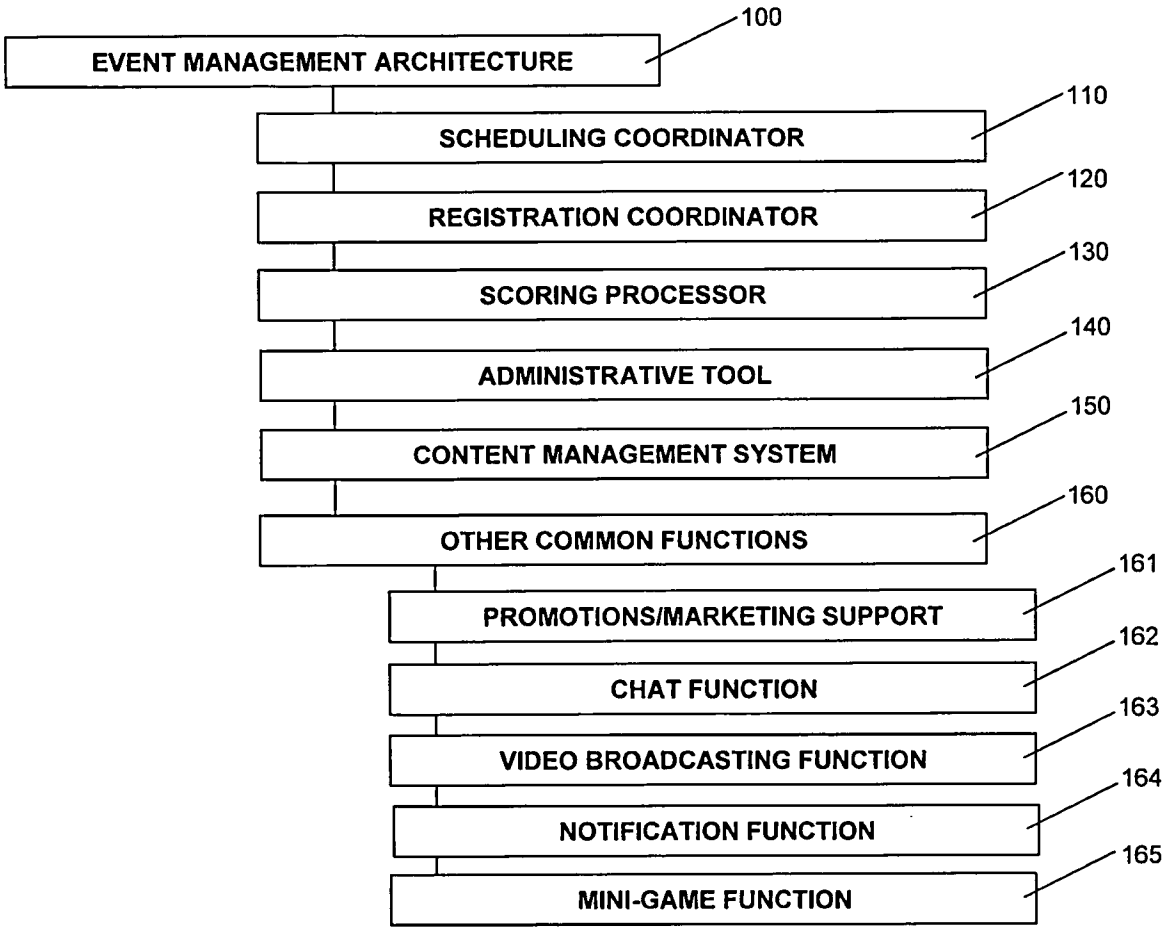
FIG. 7A illustrates another functional schematic for an exemplary embodiment of an event management architecture.
Figure 7B:
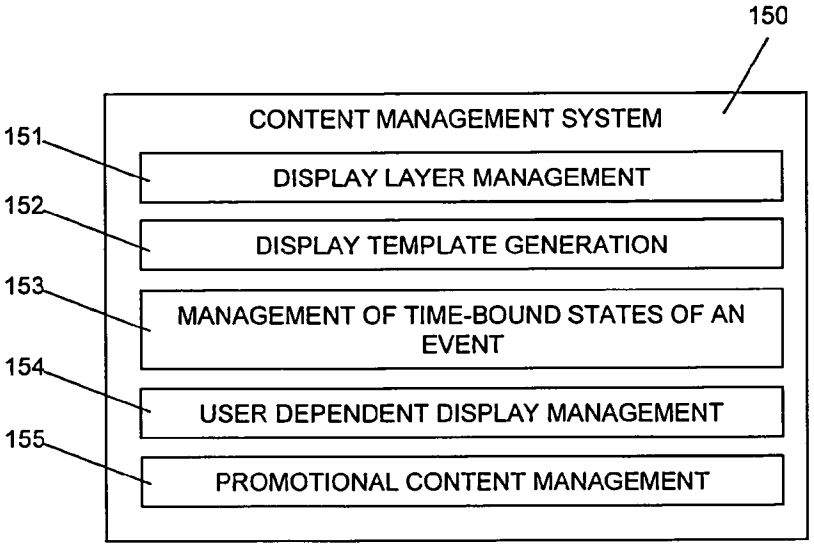
FIG. 7B illustrates a content management system for an exemplary embodiment of an event management architecture.
Figure 7C:
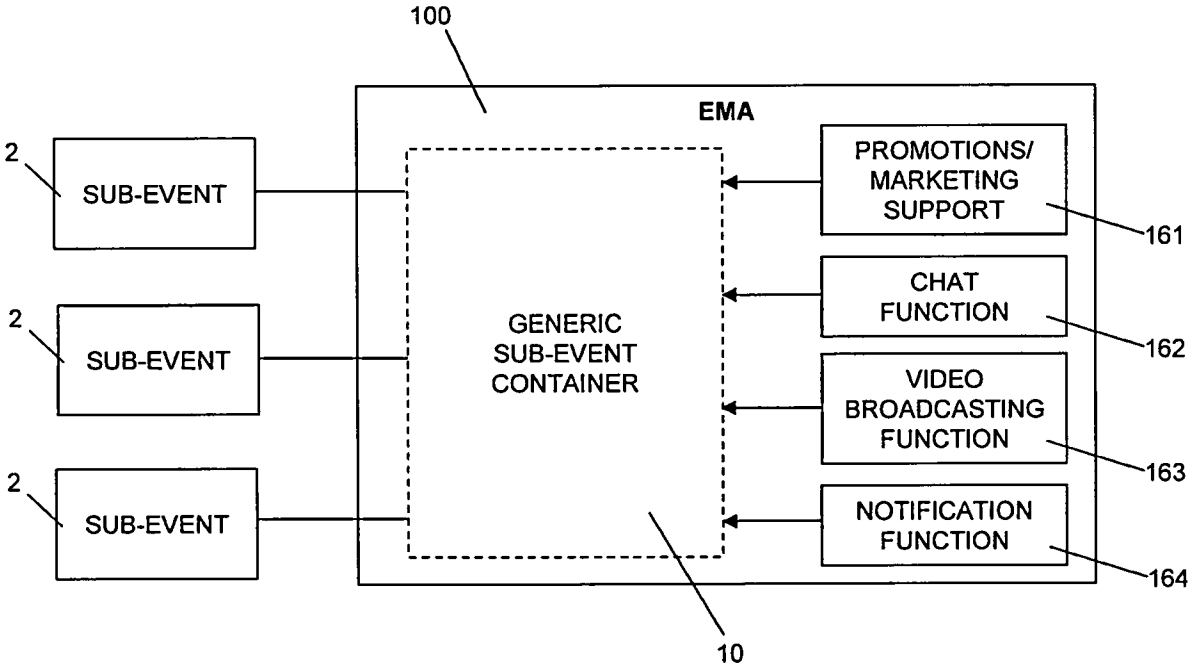
FIG. 7C illustrates yet another operational diagram for an exemplary embodiment of an event management architecture employing a generic sub-event container.

As shown in FIGS. 7A and 7C, the EMA 100 may provide common functions 160, which can be provided through the sub-event container 10. Advantageously, as illustrated in FIG. 7C, the common functions 160 may be applied more generally to sub-event containers 10, rather than to each sub-event 2. As such, any combination of these other common functions 160 may be employed with the definition of a sub-event container 10, so that any sub-event associated with the sub-event container 10 may share in the use of the common functions 160. The EMA 100 provides a standard centralized utility that manages these common functions and minimizes the need to administer the events individually.

In one embodiment, the EMA 100 provides promotions/marketing support 161 for the gaming event and each sub-event. For example, the EMA 100 may generate online advertisements for online gaming sub-events associated with a particular generic sub-event container. The EMA may provide standardized marketing and advertising to the generic container, thereby providing the same marketing and advertising to each sub-event associated with the generic container. If different promotions/marketing functionality is to be applied to different respective groups of sub-events, different generic containers can correspondingly be created for each group.

As shown in FIG. 7A, other common functions 160 may include a chat function 162, video broadcasting 163, a notification function 164, and a mini-game function 165. The chat function 162, such as web chat, enables communication by text, voice, etc. between individuals during a sub-event 2, particularly over an electronic network. The notification function 164 provides alerts and other information regarding a sub-event 2 to be communicated, for example by e-mail, to participants 20. The video broadcasting function 163 enables a sub-event to employ video elements or to be broadcast by video. The mini-game function 165 enables a sub-event to employ a mini-game, which is typically a short, simple video game contained within another game, such as the sub-event.

FIG. 7C illustrates the use of some of the common functions 160. A plurality of sub-events 2 is associated with a generic sub-event container 10 managed by the EMA 100. The sub-events 2 may be games which employ the chat function 162 for interactive participation by participants 20. The sub-events 2 may also include video elements that are broadcast live by the video broadcasting function 163. In addition, the sub-events 2 may also include a post-event on-demand video broadcast, which is also enabled by the video broadcasting function 163. The sub-events 2 also use the notification function 164 to send out reminders by e-mail, text message, voice message, or the like, to the participants 20 to ensure that they arrive in time for the live video broadcast. Moreover, the same promotions/marketing support 161 may be employed to announce and promote the scheduling of the sub-events 2.

In general, the EMA 100 may keep persistent records on generic sub-event containers. The persistent records may also be accessible through the EMA interface 212 shown in FIG. 3. Each defined generic container may be identified by a persistent unique identifier, or container name. The EMA 100 associates the generic container with the actual sub-event, and, as discussed previously, maintains records on the sub-event, such as the start date/time and end date/time. Once the EMA 100 associates actual sub-events with containers, the EMA 100 may then centrally manage aspects of the sub-events more broadly and more simply according to their generic containers.

The EMA 100 may also keep persistent records on each participant 20. As discussed above with reference to FIG. 4B, each participant 20 may be identified by an individual's name, a team name, an identification number, or the like. In one embodiment, a gaming community which employs the EMA 100 may provide members with a general registration ID, which the EMA 100 may use as an identifier when registering participants in any gaming event. In this case, only members with accounts in the gaming community may be participants for gaming events managed by the EMA 100. Moreover, scoring in gaming events managed by the EMA 100 may be used to grant members of the community more general account points, which can then be used to rank members of the gaming community. The general account points are also tracked by the members' general registration ID.

As further shown in FIG. 7A, the EMA 100 may also include a central administration tool 140, which may be operable through the EMA interface 212 shown in FIG. 3. Among a variety of functions monitoring and controlling the operation of the EMA 100, the administrative tool 140 enables an administrator to define the sub-event containers 10. The tool 140 may also enable the administrator to define participation prerequisites and operate the scheduling coordinator 110 to schedule the sub-event containers 10 according to the participation prerequisites, even before the sub-events 2 have been created or associated with the sub-event containers 10. Advantageously, the tool 140 enables management of the gaming event 1 through sub-event containers 10, without regard to the specific details of each sub-event 2. Furthermore, the tool 140 may be employed to incorporate standalone sub-events.

In addition to the administrative tool 140, the EMA 100 may also include a central content management system 150, as shown in FIG. 7A, which may be employed with sub-event containers. Advantageously, the content management system 150 may be used for time-bound content. As outlined in FIG. 7B, the content management system 150 includes display layer management 151, display template generation 152, management 153 of time-bound states for an event, user dependent display management 154, and promotional content management 155.

The content management system 150 may manage the display layer, e.g. HTML, flash, or the like, for an event series or individual components. Using the content management system 150, production staff may also generate and customize display templates. The content management system 150 also manages the display of multiple time-bound states of an event, so that as the EMA 100 controls each phase of the event, it presents contextual information and custom display elements to the user. Furthermore, the content management system 150 can manage and customize displays according to different types of users. In an online gaming site, for example, such users may include non-paying unregistered users, non-paying registered users, and paid subscribers. Additionally, the content management system 150 can manage display elements for promotional/marketing activities.

In general, it is realized that a gaming event may have a duration (e.g. a duration of several days) that may involve many participants 20 and many different sub-events. In this case, the EMA 100 may manage many changes over the duration of the gaming event. As such, displays corresponding to the gaming event may also change. Therefore, while tool-based templatization is employed to promote scalability, standardization, and efficiency, a large degree of evolutionary customization, i.e. direct template editing, is permitted to track gaming event changes more effectively.

As discussed above, aspects of embodiments of the present invention may employ electronic processing systems, such as the one or more computer servers 211 illustrated in FIG. 3. Accordingly, all or a portion of the devices and subsystems of the exemplary embodiments can be conveniently implemented using one or more general purpose computer systems, microprocessors, digital signal processors, micro-controllers, and the like, programmed according to the teachings of the exemplary embodiments of the present inventions, as is appreciated by those skilled in the computer and software arts. Appropriate software can be readily prepared by programmers of ordinary skill based on the teachings of the exemplary embodiments, as is appreciated by those skilled in the software art. Further, the devices and subsystems of the exemplary embodiments can be implemented on the World Wide Web. In addition, the devices and subsystems of the exemplary embodiments can be implemented by the preparation of application-specific integrated circuits or by interconnecting an appropriate network of conventional component circuits, as is appreciated by those skilled in the electrical art(s). Thus, the exemplary embodiments are not limited to any specific combination of hardware circuitry and/or software.

Stored on any one or on a combination of computer readable media, the exemplary embodiments of the present inventions can include software for controlling the devices and subsystems of the exemplary embodiments, for driving the devices and subsystems of the exemplary embodiments, for enabling the devices and subsystems of the exemplary embodiments to interact with a human user, and the like. Such software can include, but is not limited to, device drivers, firmware, operating systems, development tools, applications software, and the like. Such computer readable media further can include the computer program product of an embodiment of the present inventions for performing all or a portion (if processing is distributed) of the processing performed in implementing the inventions. Computer code devices of the exemplary embodiments of the present inventions can include any suitable interpretable or executable code mechanism, including but not limited to scripts, interpretable programs, dynamic link libraries (DLLs), Java classes and applets, complete executable programs, Common Object Request Broker Architecture (CORBA) objects, and the like. Moreover, parts of the processing of the exemplary embodiments of the present inventions can be distributed for better performance, reliability, cost, and the like.

The devices and subsystems of the exemplary embodiments can include computer readable media or memories for holding instructions programmed according to the teachings of the present inventions and for holding data structures, tables, records, and/or other data described herein. Computer readable medium can include any suitable medium that participates in providing instructions to a processor for execution. Such a medium can take many forms, including but not limited to, non-volatile media, volatile media, transmission media, and the like. Non-volatile media can include, for example, optical or magnetic disks, magneto-optical disks, and the like. Volatile media can include dynamic memories, and the like. Transmission media can include coaxial cables, copper wire, fiber optics, and the like. Transmission media also can take the form of acoustic, optical, electromagnetic waves, and the like, such as those generated during radio frequency (RF) communications, infrared (IR) data communications, and the like. Common forms of computer-readable media can include, for example, a floppy disk, a flexible disk, hard disk, magnetic tape, any other suitable magnetic medium, a CD-ROM, CDRW, DVD, any other suitable optical medium, punch cards, paper tape, optical mark sheets, any other suitable physical medium with patterns of holes or other optically recognizable indicia, a RAM, a PROM, an EPROM, a FLASH-EPROM, any other suitable memory chip or cartridge, a carrier wave or any other suitable medium from which a computer can read.

As the EMA 100 may employ electronic forms of data storage, the EMA 100 may also provide archiving and data store functionality. In particular, the EMA 100 may provide mechanisms for purging or archiving data per sub-event. As long as the data from a sub-event remains unpurged, the results from that sub-event are available for evaluating an individual's eligibility for a dependent sub-event.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

What is claimed is:

1. A system for managing gaming events, the system comprising:

a management computing device adapted to receive information regarding a first sub-event associated with a gaming event having one or more participants, the information regarding the first sub-event providing a first sub-event score to at least one first sub-event participant of the one or more participants according to a set of first sub-event rules during a first sub-event interval, the first sub-event score being in a first format, and information regarding a second sub-event associated with the gaming event, the information regarding the second sub-event providing a second sub-event score to at least one second sub-event participant of the one or more participants according to a set of second sub-event rules during a second sub-event interval, the second sub-event score being in a second format that is different from the first format;

a scheduling coordinator computing device adapted to schedule, for the first sub-event, the first sub-event interval, and for the second sub-event, the second sub-event interval;

a registration coordinator computing device adapted to register, for the first sub-event, the at least one first sub-event participant, and, for the second sub-event, the at least one second sub-event participant; and a scoring processor computing device adapted to convert the first sub-event score and the second sub-event score into a standard format, record the first sub-event score in the standard format and the second sub-event score in the standard format, and determine whether each of the at least one first sub-event participant and the at least one second sub-event participant qualifies to be a participant in a subsequent sub-event associated with the gaming event based on the first sub-event score in the standard format and the second sub-event score in the standard format.

2. The system according to claim 1, wherein the rules for the first sub-event is different from the rules of the second sub-event.

3. The system according to claim 1, wherein the scheduling coordinator schedules the second sub-event interval to begin after the first sub-event interval is completed.

4. The system according to claim 1, wherein the registration coordinator registers, for at least one of the first sub-event and the second sub-event, at least one sub-event participant during a registration interval, and the scheduling coordinator further schedules, for at least one of the first sub-event and the second sub-event, the registration interval.

5. The system according to claim 4, wherein the scheduling coordinator schedules the sub-event interval for at least one of the first sub-event and the second sub-event to begin after the registration interval is completed for the at least one of the first sub-event and the second sub-event.

6. The system according to claim 4, wherein the scheduling coordinator schedules the sub-event interval for at least one of the first sub-event and the second sub-event to begin before the registration interval is completed for the at least one of the first sub-event and the second sub-event.

7. The system according to claim 1, wherein at least one of the first sub-event and the second sub-event are associated with at least one independent sub-event, and registration, by the registration coordinator, of at least one sub-event participant in the at least one independent sub-event is independent of participation by the at least one sub-event participant in either the first sub-event or the second sub-event.

8. The system according to claim 1, wherein at least one of the first sub-event and the second sub-event is associated with at least one prerequisite sub-event and a dependent sub-event, and the registration, by the registration coordinator, of at least one sub-event participant in the dependent sub-event depends on participation by the at least one sub-event participant in the at least one prerequisite sub-event.

9. The system according to claim 8, wherein registration, by the registration coordinator, of the at least one sub-event participant in the dependent sub-event further requires the at least one sub-event participant to satisfy participation criteria associated with the at least one prerequisite sub-event.

10. The system according to claim 9, wherein registration, by the registration coordinator, of the at least one sub-event participant in the dependent sub-event further requires the at least one sub-event participant to have at least one of a minimum score, a minimum qualifying percentile, and a minimum ranking from each of the at least one prerequisite sub-event.

11. The system according to claim 9, wherein registration, by the registration coordinator, of the at least one sub-event participant in the dependent sub-event participant further requires the at least one sub-event participant to have a minimum pooled score determined from the at least one prerequisite sub-event.

12. The system according to claim 11, wherein, before the minimum pooled score is determined for the at least one sub-event participant, a weighting factor is applied, for each prerequisite sub-event, to the sub-event score for the at least one sub-event participant.

13. The system according to claim 11, wherein the pooled score is the average score from the at least one prerequisite sub-event.

14. The system according to claim 1, wherein at least one of the first sub-event score and the second sub-event score includes at least one of a raw score, a percentile placement, and a rank position.

15. The system according to claim 1, wherein at least one of the first sub-event and the second sub-event occurs through a standalone system.

16. The system according to claim 15, wherein the scheduling coordinator synchronizes scheduling with the standalone system.

17. The system according to claim 1, wherein the first sub-event and the second sub-event are associated with a common container.

18. The system according to claim 17, wherein the common container is associated with persistent records in a database.

19. The system according to claim 17, wherein standardized promotion for at least one of the first sub-event and the second sub-event is provided via the common container.

20. The system according to claim 17, wherein an online chat element is provided via the common container.

21. The system according to claim 17, wherein a video broadcasting element is provided via the common container.

22. The system according to claim 17, wherein a minigame element is provided via the common container.

23. The system according to claim 17, wherein a notification element is provided via the common container.

24. The system according to claim 1, wherein at least one of the first sub-event participant and the second sub-event participant is associated with persistent records in a database.

25. The system according to claim 1, further comprising a central administrative tool.

26. The system according to claim 1, wherein the gaming event is electronic.

27. The system according to claim 1, wherein at least one of the first sub-event and the second sub-event is electronic.

28. The system according to claim 1, wherein at least one of the registration coordinator, the scheduling coordinator, and the scoring processor operates on a computer device.

29. The system according to claim 1, further comprising an interface for viewing data for the gaming event.

30. The system according to claim 1, further comprising a content management tool managing electronically displayed content associated with the gaming event.

31. The system according to claim 30, wherein the content management tool manages a display layer for the gaming event or at least one of the first sub-event and the second sub-event.

32. The system according to claim 30, wherein the content management tool generates customizable display templates.

33. The system according to claim 30, wherein the content management tool manages display of at least one of contextual information and custom display elements associated with multiple time-bound states of the gaming event.

34. The system according to claim 30, wherein the content management tool manages display content according to types of viewers.

35. The system according to claim 30, wherein the content management tool manages promotional content.

36. A method for managing gaming events, the method comprising:

receiving, by a management computing device, information regarding a first sub-event associated with a gaming event having one or more participants, the information regarding the first sub-event providing a first sub-event score to at least one first sub-event participant of the one or more participants according to a set of first sub-event rules during a first sub-event interval, the first sub-event score being in a first format, and information regarding a second sub-event associated with the gaming event, the information regarding the second sub-event providing a second sub-event score to at least one second sub-event participant of the one or more participants according to a set of second sub-event rules during a second sub-event interval, the second sub-event score being in a second format that is different from the first format;

registering, by a registration coordinator computing device, for the first sub-event, the at least one first sub-event participant, and, for the second sub-event, the at least one second sub-event participant;

scheduling, by a scheduling coordinator computing device, for the first sub-event, the first sub-event interval, and for the second sub-event, the second sub-event interval;

converting, by a scoring processor computing device, the first sub-event score and the second sub-event score into a standard format;

recording, by the scoring processor computing device, the first sub-event score in the standard format and the second sub-event score in the standard format; and determining, by the scoring processor computing device, whether each of the at least one first sub-event participant and the at least one second sub-event participant qualifies to be a participant in a subsequent sub-event associated with the gaming event based on the first sub-event score in the standard format and the second sub-event score in the standard format.

37. The method according to claim 36, wherein the rules for the first sub-event is different from the rules of the second sub-event.

38. The method according to claim 36, wherein the step of scheduling includes scheduling the second sub-event interval to begin after the first sub-event interval is completed.

39. The method according to claim 36, wherein the step of scheduling includes scheduling the first sub-event interval to begin after the registration interval is completed for the first sub-event.

40. The method according to claim 36, wherein the step of scheduling includes scheduling the first sub-event interval to begin before the registration interval is completed for the first sub-event.

41. The method according to claim 36, wherein the step of converting the first sub-event score and the second sub-event score into the standard format includes normalizing the first sub-event score and the second sub-event score.

42. The method according to claim 36, wherein at least one of the first sub-event and the second sub-event are associated with at least one independent sub-event, and registering at least one sub-event participant in the at least one independent sub-event is independent of participation by the at least one sub-event participant in either the first sub-event or the second sub-event.

43. The method according to claim 36, wherein at least one of the first sub-event and the second sub-event are associated with at least one prerequisite sub-event and a dependent sub-event, and registering at least one sub-event participant in the dependent sub-event depends on participation by the at least one sub-event participant in the at least one prerequisite sub-event.

44. The method according to claim 43, wherein registering at least one sub-event participant in the dependent sub-event further requires at least one sub-event participant to satisfy criteria associated with the at least one prerequisite sub-event.

45. The method according to claim 44, wherein registering at least one sub-event participant in the dependent sub-event further requires the at least one sub-event participant to have at least one of a minimum score, a minimum qualifying percentile, and a minimum ranking from each of the at least one prerequisite sub-event.

46. The method according to claim 44, further comprising determining, from the at least one prerequisite sub-event, a pooled score for the at least one sub-event participant, wherein registering at least one sub-event participant in the dependent sub-event participant further requires the at least one sub-event participant to have a minimum pooled score.

47. The method according to claim 46, further comprising, before the step of determining the minimum pooled score for the at least one sub-event participant, applying a weighting factor, for each prerequisite sub-event, to the sub-event score for the at least one sub-event participant.

48. The method according to claim 46, wherein the step of determining, from the at least one prerequisite sub-event, a pooled score comprises averaging, for the at least one sub-event participant, the sub-event score from the at least one prerequisite sub-event.

49. The method according to claim 36, wherein at least one of the first sub-event score and the second sub-event score includes at least one of a raw score, a percentile placement, and a rank position.

50. The method according to claim 36, wherein at least one of the first sub-event and the second sub-event occurs through a standalone system.

51. The method according to claim 50, wherein the step of scheduling includes synchronizing a schedule with the standalone system.

52. The method according to claim 36, further comprising associating each of the first sub-event and the second sub-event with a common container.

53. The method according to claim 52, further comprising storing persistent records for the common container.

54. The method according to claim 52, further comprising providing standardized promotion via the common container.

55. The method according to claim 52, further comprising providing an online chat element via the common container.

56. The method according to claim 52, further comprising providing a video broadcasting element via the common container.

57. The method according to claim 52, further comprising providing a notification element via the common container.

58. The method according to claim 36, further comprising storing persistent records for at least one of the first sub-event participant and the second sub-event participant.

59. The method according to claim 36, wherein the gaming event is electronic.

60. The method according to claim 36, wherein at least one of the first sub-event and the second sub-event is electronic.

61. The method according to claim 36, wherein at least one of the step of registering, the step of scheduling, the step of converting, and the step of recording comprises executing instructions on a computer.

62. The method according to claim 36, further comprising providing an interface for viewing data for the gaming event.

63. The method according to claim 36, further comprising centrally managing electronically displayed content associated with the gaming event.

64. The method according to claim 63, wherein the step of centrally managing electronically displayed content associated with the gaming event includes managing a display layer for the gaming event or at least one of the first sub-event and the second sub-event.

65. The method according to claim 63, wherein the step of centrally managing electronically displayed content associated with the gaming event includes generating customizable display templates.

66. The method according to claim 63, wherein the step of centrally managing electronically displayed content associated with the gaming event includes displaying at least one of contextual information and custom display elements associated with multiple time-bound states of the gaming event.

67. The method according to claim 63, wherein the step of centrally managing electronically displayed content associated with the gaming event includes displaying content according to types of viewers.

68. The method according to claim 63, wherein the step of centrally managing electronically displayed content associated with the gaming event includes managing promotional content.

* * * * *